US009538274B1

(12) United States Patent
Yang et al.

(10) Patent No.: US 9,538,274 B1
(45) Date of Patent: Jan. 3, 2017

(54) SMART MICROPHONE WITH VOICE CONTROL FUNCTIONS

(71) Applicant: HIT INCORPORATED, New Taipei (TW)

(72) Inventors: Sung-Shou Yang, New Taipei (TW); Shuo-Hung Chu, New Taipei (TW)

(73) Assignee: HIT INCORPORATED, New Taipei (TW)

( * ) Notice: Subject to any disclaimer, the term of this patent is extended or adjusted under 35 U.S.C. 154(b) by 0 days.

(21) Appl. No.: 14/875,193

(22) Filed: Oct. 5, 2015

(51) Int. Cl.

| | |
|---|---|
| ***H04R 3/00*** | (2006.01) |
| ***H04R 1/04*** | (2006.01) |
| ***H04R 29/00*** | (2006.01) |
| ***H04R 1/02*** | (2006.01) |

(52) U.S. Cl.
CPC ..... *H04R 1/04* (2013.01); *H04R 1/028* (2013.01); *H04R 29/004* (2013.01)

(58) Field of Classification Search
CPC ... H04R 19/005; H04R 19/04; H04R 2499/13; H04R 2499/11; H04R 3/00; H04R 17/005; H04R 17/025; H04R 17/00; H04R 19/016; H04R 1/406; H04R 1/46; H04R 2201/023; H04L 67/18; H04L 29/06027; H04L 65/1026; H04L 65/80; H04L 12/282; H04L 12/2827; H04L 12/2854; H04L 2012/2841; H04B 1/385; H04B 5/0037; H04H 20/76; H04H 60/94; H04K 1/06; H04S 2400/09; H04S 7/301
USPC ..... 381/110, 170–181, 189, 191, 92, 190; 275/701; 73/514.32
See application file for complete search history.

(56) References Cited

U.S. PATENT DOCUMENTS

| | | | | |
|---|---|---|---|---|
| 6,093,144 | A * | 7/2000 | Jaeger | H04R 25/606 600/25 |
| 8,150,082 | B2 * | 4/2012 | Saito | H04R 25/60 381/189 |
| 8,194,896 | B2 * | 6/2012 | Hsiao | B81B 7/0061 257/416 |
| 2002/0191802 | A1 * | 12/2002 | Choe | H04R 23/00 381/92 |
| 2008/0165996 | A1 | 7/2008 | Saito et al. | |
| 2008/0166000 | A1 | 7/2008 | Hsiao | |
| 2008/0167516 | A1 | 7/2008 | Jaeger et al. | |

(Continued)

FOREIGN PATENT DOCUMENTS

| | | |
|---|---|---|
| TW | I279155 B | 4/2007 |
| TW | M333740 U | 6/2008 |

(Continued)

*Primary Examiner* — Lun-See Lao
(74) *Attorney, Agent, or Firm* — Chun-Ming Shih; HDLS IPR Services

(57) ABSTRACT

A smart microphone has voice control functions. The smart microphone includes a support plate, a microphone component, at least a sensor, at least an integrated component, a sound pressure conversion component and a plurality of welding pads. The microphone component is arranged on a surface of the support plate. The sensor, the integrated component and the sound pressure conversion component are arranged inside the microphone component. The welding pads are arranged on two sides of the support plate respectively. The sensors with environment volume monitoring, voice control and different functions are integrated into the microphone component to achieve the smart microphone with a small volume and multi-functions.

10 Claims, 5 Drawing Sheets

(56) References Cited

U.S. PATENT DOCUMENTS

2010/0195864 A1* 8/2010 Lutz ..... H04R 19/04
381/433

FOREIGN PATENT DOCUMENTS

TW I298984 B 7/2008
TW M335900 U 7/2008

* cited by examiner

SMART MICROPHONE WITH VOICE CONTROL FUNCTIONS

BACKGROUND OF THE INVENTION

Field of the Invention

The present invention relates to a microphone, and especially relates to a smart microphone with voice control functions.

Description of the Related Art

Currently, electronic apparatuses which need to transmit sounds, such as cellphones, computers, personal digital assistant (PDA), voice over internet protocol (VoIP) apparatuses, MP3 players, game consoles, headphones, portable global position system (GPS) apparatuses or other similar electronic apparatuses, all have microphones which receive sounds and are arranged inside the electronic apparatuses or on circuit boards inside the electronic apparatuses.

After built-in microphones (the capacitor microphones) are arranged in the electronic apparatuses, in order to improve the sound processing efficiency of the microphones, how to effectively suppress noises, eliminate wind sounds, eliminate echo and meet the needs of miniaturization and high power are usually the key items of the technology development. Therefore, related arts comprise the patent numbers I279155, I298984 and M335900 of the Republic of China, and patent numbers 20080167516, 20080166000 and 20080165996 of the United States. In the related arts, the microphones convert the sound waves into electric signals. Namely, the microphones provide only the function of converting the sound waves into the electric signals.

However, the patent number M333740 of the Republic of China discloses a microphone that can light and light diversely. The casing of the microphone is made of light-permeable material. A light source, such as light-emitting diodes (LEDs), variable optical diodes, tubes, bulbs or lamps, is arranged inside the microphone, to light diversely according to different situations. However, the microphone disclosed in M333740 is a wire microphone or a wireless microphone that is independent from the electronic apparatus (namely, cannot be integrated with the electronic apparatus), and is used and held by the user for transmitting sounds. In another word, the microphone disclosed in M333740 cannot be miniaturized to be directly used as the microphone of the cellphones, computers, personal digital assistant (PDA), voice over internet protocol (VoIP) apparatuses, MP3 players, multimedia players, game consoles, headphones, portable global position system apparatuses or other similar electronic apparatuses.

Therefore, currently the microphone in the electronic apparatus only has the function of transmitting sounds. The other functions of the electronic apparatus are achieved by the other components of the electronic apparatus. Therefore, how to provide a microphone that can integrate different functions in the electronic apparatus is a key point that is worth to research and design in the field.

SUMMARY OF THE INVENTION

Therefore, the main object of the present invention is to provide a smart microphone comprising a sound pressure conversion component which is arranged inside the smart microphone to receive microphone output audio signals to proceed with the environment volume monitoring or voice control application to achieve the smart microphone with voice control functions.

Another object of the present invention is to provide a smart microphone with a flexible design to reduce the volume of the smart microphone.

Still another object of the present invention is that the smart microphone comprises at least a sensor which is arranged inside the smart microphone to sense various environment, biology, position/height, orientation, angle or velocity.

In order to achieve the object mentioned above, the present invention provides a smart microphone with voice control functions. The smart microphone comprises a support plate, a microphone component, a sound pressure conversion component, at least a sensor, at least an integrated component and a plurality of welding pads. The support plate comprises a first surface and a second surface which is opposite to the first surface. The welding pads are arranged on the first surface and the second surface. The welding pads which are arranged on the first surface and the second surface are electrically connected to each other respectively. The microphone component is arranged on the first surface and is electrically connected to at least one of the welding pads. The sound pressure conversion component is arranged on the first surface and is arranged inside the microphone component and is electrically connected to at least one of the welding pads. The sensor is arranged on the first surface and is arranged inside the microphone component and is electrically connected to at least one of the welding pads. The integrated component is arranged on the first surface and is arranged inside the microphone component and is electrically connected to at least one of the welding pads.

In an embodiment of the present invention, the support plate is one of a baseplate and a circuit board.

In an embodiment of the present invention, the integrated component is electrically connected to the welding pad through a wire.

In an embodiment of the present invention, the smart microphone further comprises a plurality of electrical connection structures penetrating the support plate to be electrically connected to the welding pads.

In an embodiment of the present invention, the electrical connection structure is one of a through hole, a blind hole and a buried hole.

In an embodiment of the present invention, the sensor is an inertia sensor, a biology sensor, a temperature sensor, a humidity sensor or a pneumatic sensor.

In an embodiment of the present invention, the inertia sensor is an accelerometer, a gyroscope or a gyrometer.

In an embodiment of the present invention, the sensor and the integrated component are integrated as an integrated circuit.

In an embodiment of the present invention, the microphone component comprises a casing, a first pad, a second pad, a vibration diaphragm, a sensing backboard and an electrical connection column. The casing comprises a sound hole and a joint part. The sound hole is arranged on a surface of the casing. The joint part is arranged on a bottom of the casing and is jointed with the support plate. The first pad and the second pad are arranged inside the casing. The vibration diaphragm is gripped and arranged between the first pad and the second pad. A chamber is formed below the second pad and is formed between the second pad and the joint part of the casing. The sensing backboard is gripped and arranged between the chamber and the second pad. The sensing backboard senses a vibration of the vibration diaphragm. The electrical connection column is arranged in the chamber and touches the sensing backboard.

In an embodiment of the present invention, a cavity accommodating the sensor, the integrated component and the sound pressure conversion component is formed in the chamber.

DETAILED DESCRIPTION OF THE INVENTION

Please refer to following detailed description and figures for the technical content of the present invention.

Figure 1:
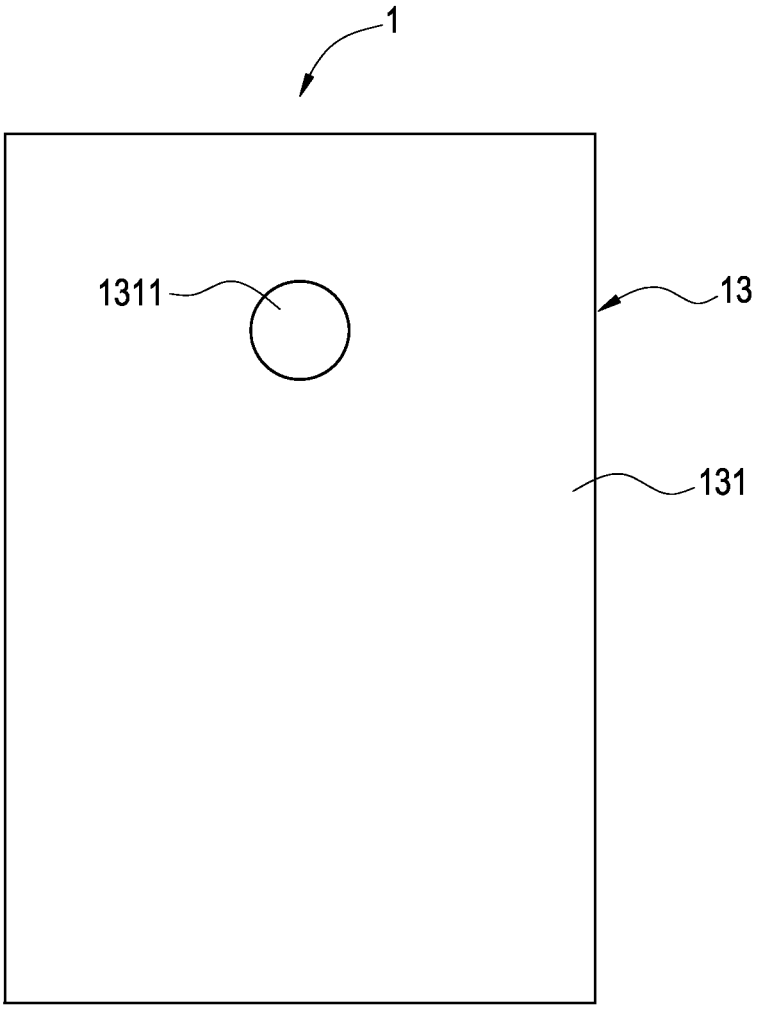
FIG. 1 shows a top view of the smart microphone of the present invention.
Figure 2:
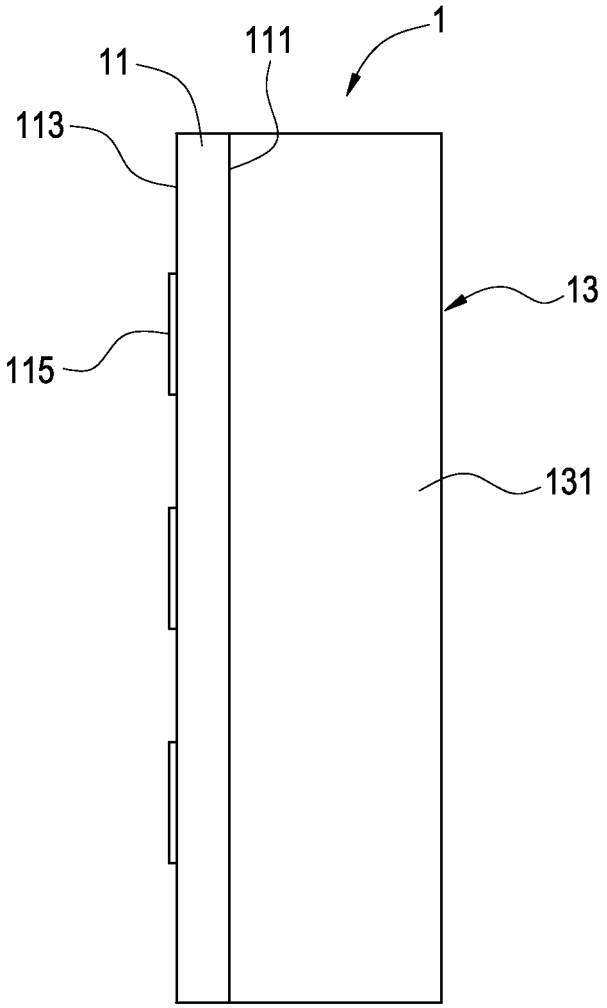
FIG. 2 shows a side view of the smart microphone of the present invention.
Figure 3:
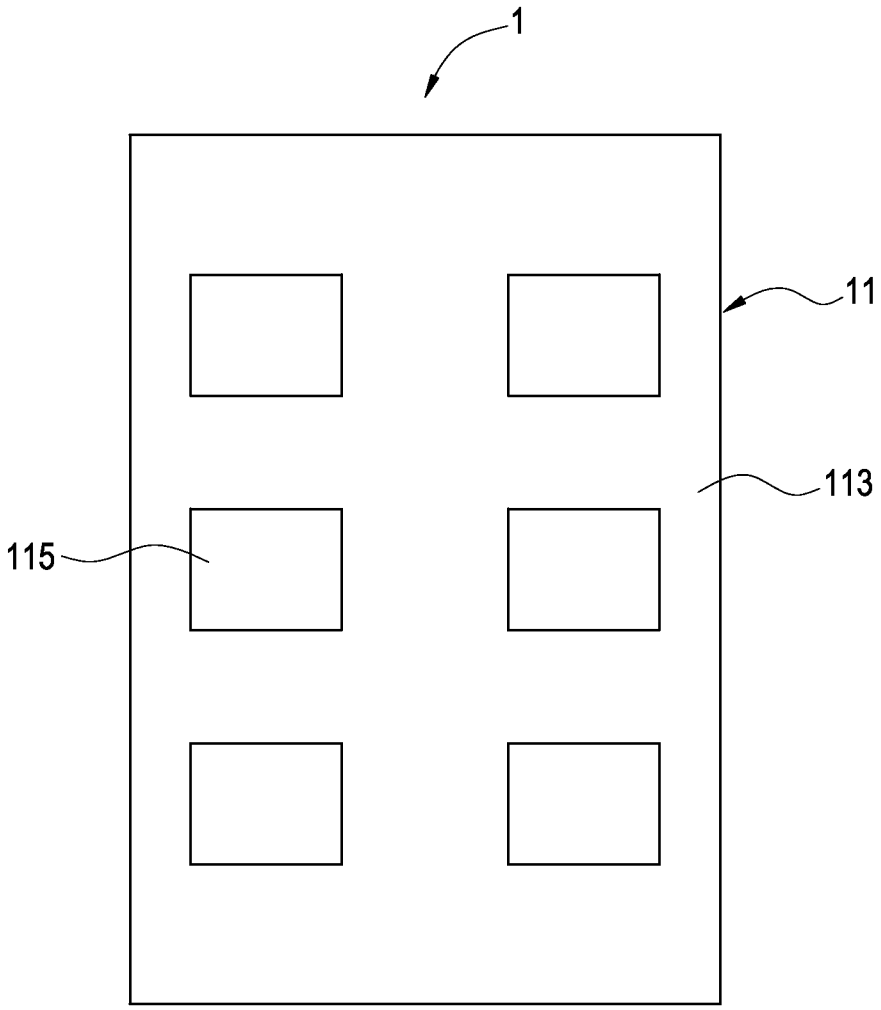
FIG. 3 shows a bottom view of the smart microphone of the present invention.

FIG. 1 shows a top view of the smart microphone of the present invention. FIG. 2 shows a side view of the smart microphone of the present invention. FIG. 3 shows a bottom view of the smart microphone of the present invention. As shown in FIG. 1, FIG. 2 and FIG. 3, the smart microphone 1 with voice control functions mainly comprises a support plate 11, a plurality of welding pads 115, a microphone component 13, at least a sensor 15, at least an integrated component 119 and a sound pressure conversion component 121. The support plate 11 comprises a first surface 111 and a second surface 113 which is opposite to the first surface 111. The welding pads 115 are arranged on the first surface 111 and the second surface 113. The welding pads 115 which are arranged on the first surface 111 and the second surface 113 are electrically connected to each other respectively. The microphone component 13 is arranged on the first surface 111 and is electrically connected to at least one of the welding pads 115. The sensor 15 is arranged on the first surface 111 and is arranged inside the microphone component 13 and is electrically connected to at least one of the welding pads 115 through a SMT pattern or a wire pattern. The integrated component 119 is arranged on the first surface 111 and is arranged inside the microphone component 13 and is electrically connected to at least one of the welding pads through the SMT pattern or the wire pattern. The sound pressure conversion component 121 is arranged on the first surface 111 and is arranged inside the microphone component 13 and is electrically connected to at least one of the welding pads through the SMT pattern or the wire pattern. Moreover, the sensor 15, the integrated component 119 and the sound pressure conversion component 121 are covered by and arranged inside the microphone component 13, and are electrically connected to the microphone component 13, and are protected by the microphone component 13, and reduce a volume of the smart microphone 1 effectively.

The support plate 11 mentioned above carries the microphone component 13, the sensor 15, the integrated component 119 and the sound pressure conversion component 121. The smart microphone 1 is combined with (namely, connected to) an electronic apparatus (not shown in FIG. 1, FIG. 2 and FIG. 3) through the welding pad 115 arranged on the second surface 113. In this embodiment, the support plate 11 is a baseplate, a circuit board or other equivalent component. Here, the baseplate or the circuit board with a simple circuit design is used as the support plate 11. However, the baseplate or the circuit board with a complex circuit design can be used as the support plate 11 as well to achieve the electrical connection between the smart microphone 1 and the electronic apparatus, so that the smart microphone 1 can transmit signals to the electronic apparatus. The present invention is not limited to it.

Figure 5:
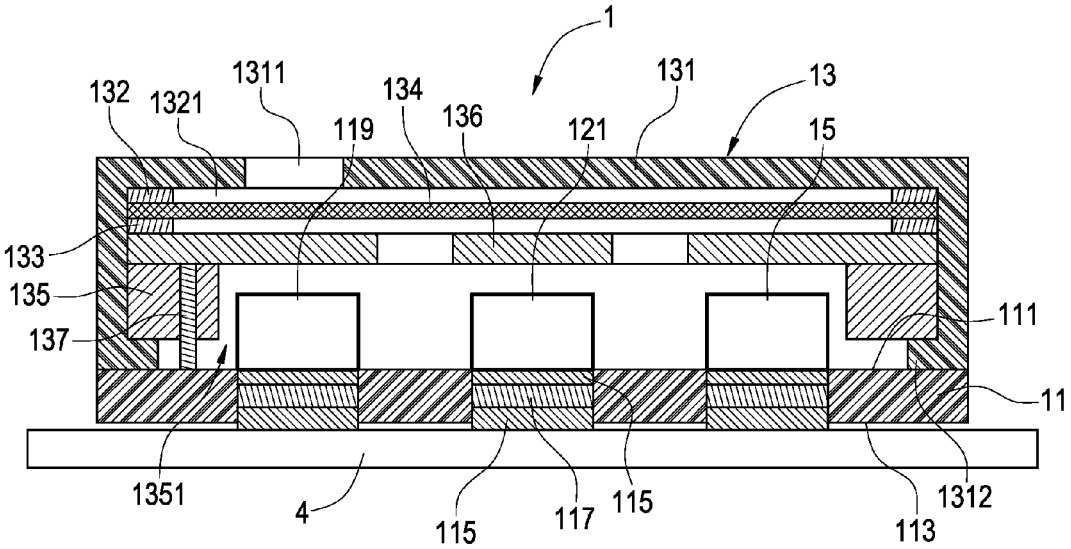
FIG. 5 shows a side sectional view of the smart microphone of the present invention.

Moreover, in this embodiment, a plurality of the welding pads 115 on the first surface 111 and the second surface 113 are utilized. A plurality of electrical connection structures 117 penetrate the support plate 11 from the first surface 111 to the second surface 113 (as shown in FIG. 5). In another word, the electrical connection structures 117 are arranged inside the support plate 11 and between the welding pads 115 (as shown in FIG. 5). The electrical connection structure 117 is, for example, a through hole, a blind hole, a buried hole or other electrical connection constructions. The electrical connection structures 117 are electrically connected to the welding pads 115 which are arranged on the first surface 111 and the second surface 113 respectively, so that the microphone component 13, the sensor 15, the integrated component 119 and the sound pressure conversion component 121 are electrically connected to related components inside the electronic apparatus through the welding pads 115.

Moreover, in this embodiment, the welding pad 115 is a rectangle, but welding pad 115 can be an annulus, a circle or other geometric shapes in other embodiments. Moreover, if the welding pad 115 is an annulus, the size of the welding pad 115 can be greater than, equal to or even smaller than the electrical connection structure 117, so that the welding pad 115 on the first surface 111 is electrically connected to the welding pad 115 on the second surface 113 conveniently. Besides, the electrical connection structures 117 can be the through holes, the blind holes or the buried holes, so that the through hole, the blind hole and/or the buried hole may exist in the support plate 11 at the same time according to the circuit design of the support plate 11. In another word, the contents mentioned in the embodiment are just for explanations but the present invention is not limited to it.

Moreover, the detail description and figures of the through hole, the blind hole, the buried hole, the electrical connection structure 117, the welding pad 115, the SMT and the soldering (welding) technology are the related arts, so would be omitted here for brevity.

Figure 4:
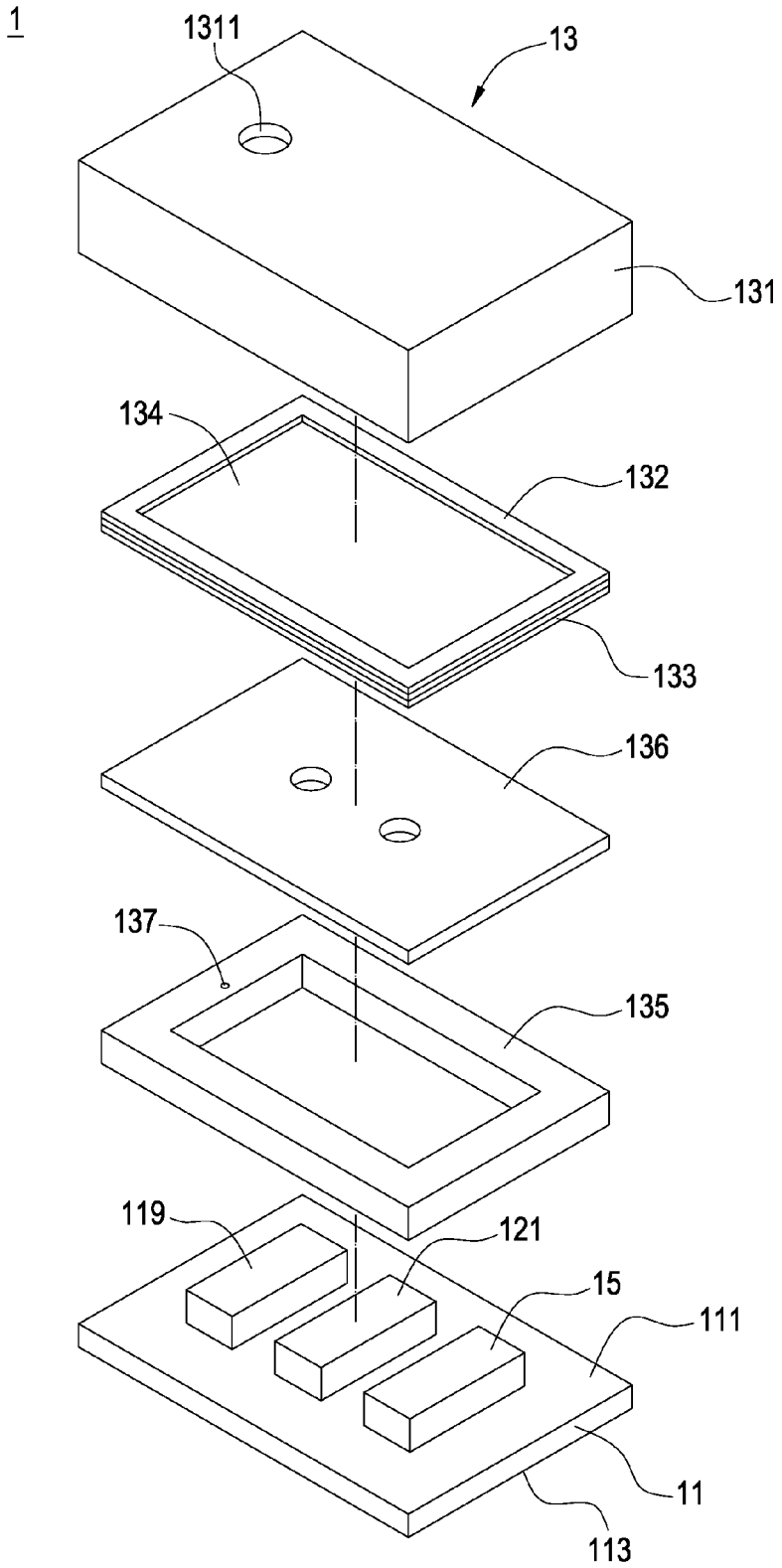
FIG. 4 shows an exploded view of the smart microphone of the present invention.
Figure 6:
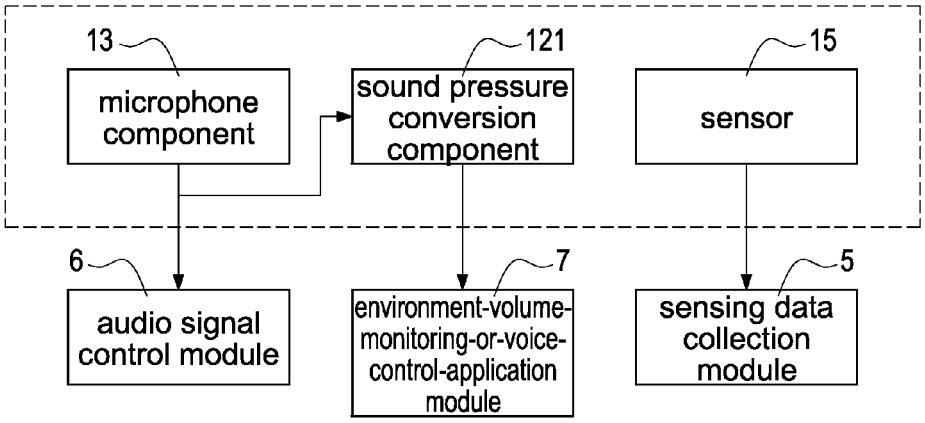
FIG. 6 shows a block diagram of the smart microphone of the present invention.

FIG. 4 shows an exploded view of the smart microphone of the present invention. FIG. 5 shows a side sectional view of the smart microphone of the present invention. FIG. 6 shows a block diagram of the smart microphone of the present invention. As shown in FIG. 4, FIG. 5 and FIG. 6, the microphone component 13 mentioned above is a related art microphone or a related art micro electro mechanical system (MEMS) microphone. For example, the microphone component 13 comprises a casing 131, a first pad 132, a second pad 133, a vibration diaphragm 134, a sensing backboard 136 and an electrical connection column 137. The casing 131 comprises a sound hole 1311 and a joint part 1312. The sound hole 1311 is arranged on a surface of the casing 131. The joint part 1312 is arranged on a bottom of the casing 131 and is jointed with the support plate 11. The first pad 132 and the second pad 133 are arranged inside the casing 131. The vibration diaphragm 134 is gripped and arranged between the first pad 132 and the second pad 133. A chamber 135 is formed below the second pad 133 and is formed between the second pad 133 and the joint part 1312 of the casing 131. The sensing backboard 136 is gripped and arranged between the chamber 135 and the second pad 133. The sensing backboard 136 senses a vibration of the vibration diaphragm 134. The electrical connection column 137 is arranged in the chamber 135 and touches the sensing backboard 136. A front space 1321 is formed between the casing 131 and the first pad 132. A cavity 1351 accommodating the sensor 15, the integrated component 119 and the sound pressure conversion component 121 is formed in the chamber 135. Moreover, the sensor 15, the integrated component 119 and the sound pressure conversion component 121 mentioned above are arranged in the cavity 1351. The support plate 11 is directly combined with a main circuit board 4 of the electronic apparatus with no gap. The content mentioned above is just an embodiment, but the microphone component 13 is not limited to it.

The sensor 15 is arranged on the welding pad 115 through the SMT pattern or the wire pattern to be electrically connected to the microphone component 13 and internal structures of the electronic apparatus. In this embodiment, the sensor 15 is an inertia sensor, such as an accelerometer, a gyroscope or a gyrometer, or the sensor 15 is a related art humidity sensor or an air pressure sensor (pneumatic sensor) and so on. As shown in FIG. 6, the sensor 15 is electrically connected to a sensing data collection module 5 of the electronic apparatus, so that the sensing data collection module 5 receives signals which are sensed by the sensor 15 to proceed with further process. The microphone component 13 is electrically connected to an audio signal control module 6 of the electronic apparatus, so that the audio signal control module 6 proceeds with further process. Moreover, the sound pressure conversion component 121 is electrically connected to an environment-volume-monitoring-or-voice-control-application module 7 of the electronic apparatus. After the sound pressure conversion component 121 receives the audio signals outputted from the microphone component 13, the environment-volume-monitoring-or-voice-control-application module 7 proceeds with further process. The sensor 15 can sense, for examples, the tilting action, accelerating movement, rotating action, vibrating action, jump action, impact action, left-right movement and other actions on a single axis (for example the X axis or the Y axis), two axes (the X axis and the Y axis) or three axes (the X axis, the Y axis and the Z axis), so that the sensor 15 senses the location, orientation (displacement) and/or posture of the electronic apparatus. Therefore, when the smart microphone 1 is applied to the electronic apparatus which utilizes the location, orientation (displacement) and/or posture to proceed with relative operations, such as a game console, a cellphone or other apparatus with the microphone, the smart microphone 1 in this embodiment can provide the electronic apparatus with relative output signals.

For example, the key operations for the cellphone can be replaced by the tilting action, rotating action and left-right movement for the cellphone by the user. The on-off operation, button operation, wheel operation and remote control operation for the game console can be replaced by sensing the posture of the game console. The function of the pedometer is integrated into the microphone of the sport MP3/PMP headphone to sense the human motion state to calculate the running distance and the burning calories. The sensor which is used for stable image detection in the cellphone, the camera, the camcorder and other electronic apparatus can be integrated into the smart microphone 1 of the present invention.

In another word, the sensor 15, such as the inertia sensor, is arranged on the main circuit board (for example, the main circuit board 4 in this embodiment) in the related art electronic apparatus. In an embodiment of the present invention, the sensor 15 is arranged inside the smart microphone 1. Therefore, the smart microphone 1 is modularized to reduce the used space (namely, required space) on the main circuit board, so that other function components can be arranged in the saving space to extend the functions of the electronic apparatus. Namely, the volume of the smart microphone 1 is reduced, so that other components with different functions can be arranged in the electronic apparatus.

Moreover, in the embodiment mentioned above, a single sensor 15 is arranged inside the microphone component 13. However, a plurality of the sensors 15 can be arranged inside the microphone component 13 as well. For example, the inertia sensor, the biology sensor, the temperature sensor, the humidity sensor, the pneumatic sensor and sensors with other functions can be arranged inside the microphone component 13 to monitor the physiological state of the user (for examples, the pulse, the blood pressure, the body temperature and so on), or monitor the environment humidity or position/height. Moreover, the sensor 15 and the integrated component 119 can be integrated as an integrated circuit by integrated circuit design. For example, the sensor 15 is integrated inside the integrated component 119. Therefore, the manufacturing cost is reduced and the volume is reduced effectively.

There are a lot of sensors 15 which can be arranged. The user with the common knowledge in the field of the technology can understand and proceed accordingly. Therefore, it would be omitted here for brevity.

In conclusion, the smart microphone 1 is modularized, so that the smart microphone 1 not only has the function of transmitting sounds, but also integrates the sound pressure conversion component 121 to proceed with environment volume monitoring, voice control application and different sensors 15 to import (namely, increase) relative functions into the electronic apparatus which is used. Moreover, according to the requirement, the sensor 15 can be any sensors with different functions, so the design of the present invention is flexible.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A smart microphone with voice control functions, the smart microphone comprising:

a support plate comprising a first surface and a second surface opposite to the first surface;

a plurality of welding pads arranged on the first surface and the second surface, the welding pads arranged on the first surface and the second surface electrically connected to each other respectively;

a microphone component arranged on the first surface and electrically connected to at least one of the welding pads;

a sound pressure conversion component arranged on the first surface and arranged inside the microphone component and electrically connected to at least one of the welding pads;

at least a sensor arranged on the first surface and arranged inside the microphone component and electrically connected to at least one of the welding pads; and at least an integrated component arranged on the first surface and arranged inside the microphone component and electrically connected to at least one of the welding pads.

2. The smart microphone in claim 1, wherein the support plate is one of a baseplate and a circuit board.

3. The smart microphone in claim 1, wherein the integrated component is electrically connected to the welding pad through a wire.

4. The smart microphone in claim 1, further comprising a plurality of electrical connection structures penetrating the support plate and electrically connected to the welding pads.

5. The smart microphone in claim 4, wherein the electrical connection structure is one of a through hole, a blind hole and a buried hole.

6. The smart microphone in claim 1, wherein the sensor is an inertia sensor, a biology sensor, a temperature sensor, a humidity sensor or a pneumatic sensor.

7. The smart microphone in claim 6, wherein the inertia sensor is an accelerometer, a gyroscope or a gyrometer.

8. The smart microphone in claim 1, wherein the sensor and the integrated component are integrated as an integrated circuit.

9. The smart microphone in claim 1, wherein the microphone component comprises a casing, a first pad, a second pad, a vibration diaphragm, a sensing backboard and an electrical connection column; the casing comprises a sound hole and a joint part; the sound hole is arranged on a surface of the casing; the joint part is arranged on a bottom of the casing and is jointed with the support plate; the first pad and the second pad are arranged inside the casing; the vibration diaphragm is gripped and arranged between the first pad and the second pad; a chamber is formed below the second pad and is formed between the second pad and the joint part of the casing; the sensing backboard is gripped and arranged between the chamber and the second pad; the sensing backboard senses a vibration of the vibration diaphragm; the electrical connection column is arranged in the chamber and touches the sensing backboard.

10. The smart microphone in claim 9, wherein a cavity accommodating the sensor, the integrated component and the sound pressure conversion component is formed in the chamber.

* * * * *